United States Patent [19]

Smith

[11] 4,113,050

[45] Sep. 12, 1978

[54] FLUID-FLOW NOISE REDUCTION SYSTEMS

[75] Inventor: Trevor Smith, Whitley Bay, England

[73] Assignee: British Gas Corporation, London, England

[21] Appl. No.: 714,984

[22] Filed: Aug. 16, 1976

[30] Foreign Application Priority Data

Sep. 25, 1975 [GB] United Kingdom ..... 39314/75

[51] Int. Cl.[2] ..... F01N 3/06; F01N 1/08; F01N 7/18

[52] U.S. Cl. ..... 181/230; 181/232; 181/257; 181/268; 181/281; 181/282; 138/41

[58] Field of Search ..... 181/35 B, 46, 56, 69, 181/49, 41, 62, 57, 60, 47 R, 230, 232, 257, 268, 281, 282; 138/40, 41, 42, 44

[56] References Cited

U.S. PATENT DOCUMENTS

| | | | |
|---|---|---|---|
| 844,669 | 2/1907 | Fairchild | 181/62 |
| 1,914,072 | 6/1933 | Boylston | 181/69 |
| 3,227,242 | 1/1966 | Mattoon | 181/69 |
| 3,232,373 | 2/1966 | Bjork | 181/69 |
| 3,556,735 | 1/1971 | Epelman | 181/69 |
| 3,665,965 | 5/1972 | Baumann | 181/46 |
| 3,964,519 | 6/1976 | De Baun | 138/41 |

FOREIGN PATENT DOCUMENTS

| | | | |
|---|---|---|---|
| 616,127 | 3/1961 | Canada | 181/69 |

*Primary Examiner*—Stephen J. Tomsky
*Attorney, Agent, or Firm*—Larson, Taylor and Hinds

[57] ABSTRACT

An 'in-line' unit for use in compressor station piping, arranged to reduce the level of noise generated when the blowdown valves of the station piping are opened in an emergency to vent the high pressure gas therein to atmosphere, the unit comprising a pipe section having a plurality of orifice plates the number and hole area of which is designed to ensure sub-sonic flow through each plate. The unit is preferably used in combination with a modified form of silencer element connected 'in-line' downstream thereof.

8 Claims, 3 Drawing Figures

Figure 1:
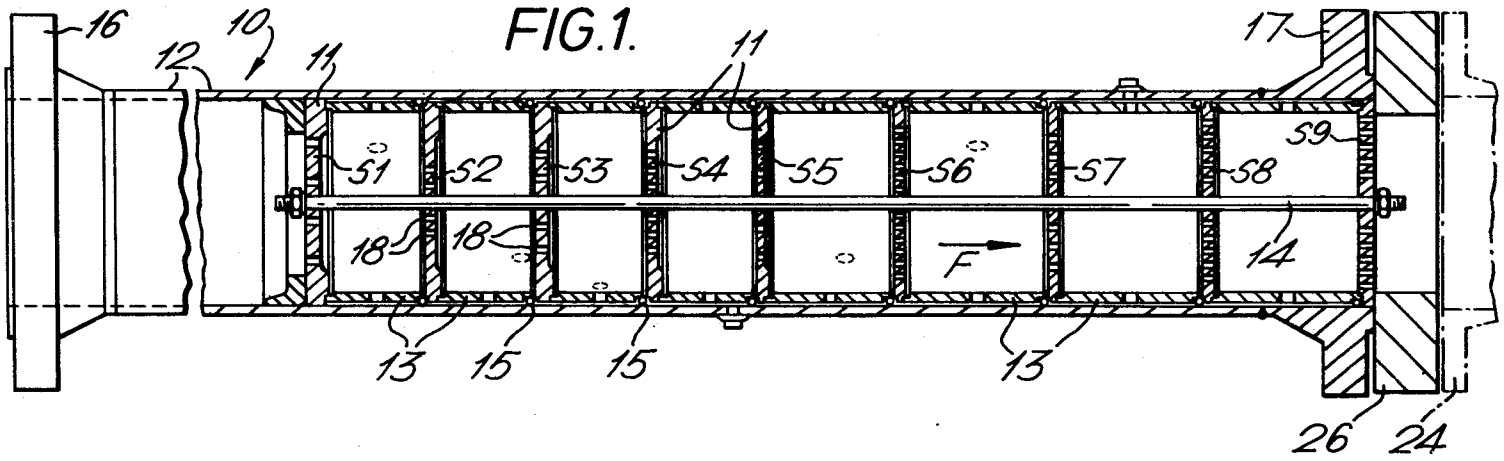

10
11
12
13
14
15
16
17
18
24
26
51
52
53
54
55
56
57
58
59
F 10
17
20
21
22
23
24
26

FLUID-FLOW NOISE REDUCTION SYSTEMS

This invention relates to compressed gas-flow noise reduction units, and particularly, although not exclusively, to such units designed for use in gas compressor station venting systems.

Usually each transmission compressor station in a gas distribution network is provided with an emergency shut-down system by means of which all gas compressing equipment in the compressor building can be shut-down and gas can be blocked out of the station and the station gas piping blown down. The blow down piping extends to a location where the discharge of compressed gas through an exhaust stack is not likely to create a hazard to the compressor station or the surrounding area. Other venting systems exist to vent down individual sections of the station.

In comtemporary design of compressor station venting systems the blow down flow is usually controlled by either a single orifice plate or a vent valve in the line. Both designs are extremely noisy, especially the latter, which, for example, can produce noise levels in excess of 120 dB at 50 meters from the exhaust stack. The noise reduction obtainable with existing line silencers is between 25–30 dB and exceptionally 35 dB with more complex types, but in most cases this performance is not sufficient to reduce the noise to an acceptable level, particularly during the night time period.

An object of the present invention is to provide an improved form of gas-flow noise reduction unit which, when used in combination with a line silencer element, will reduce the noise level in a gas-flow venting system to a reasonable level.

According to the present invention a gas-flow noise reduction unit comprises a cylindrical housing having means at each end thereof for connection in the pipeline of an exhaust stack, a plurality of circular plates located diametrically at predetermined spaced intervals along the length of the internal bore of the housing, each plate being formed with a plurality of orifices of predetermined size and constituting a stage of the unit, and means for retaining the plates at said locations within the housing.

The spacing between each succeeding plate in the direction of gas-flow may be of progressively increasing dimension, although preferably the plates are arranged in groups of plates, two or more plates to each group, the spacing between each plate in any group being equal, with the spacing between each group of plates in the direction of gas flow being of progressively increasing dimension.

Preferably, the noise reduction unit is intended to be used in combination with the aforesaid silencer element which is connected down-stream of the unit, and it will be understood that the invention includes within its scope a compressed gas venting system incorporating such a combination.

Figure 3:
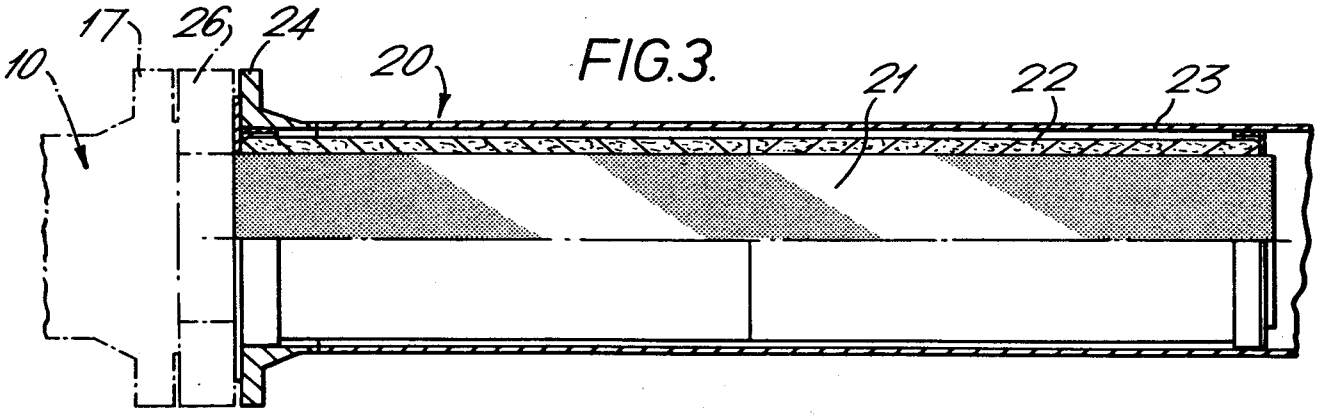
Figure 2:
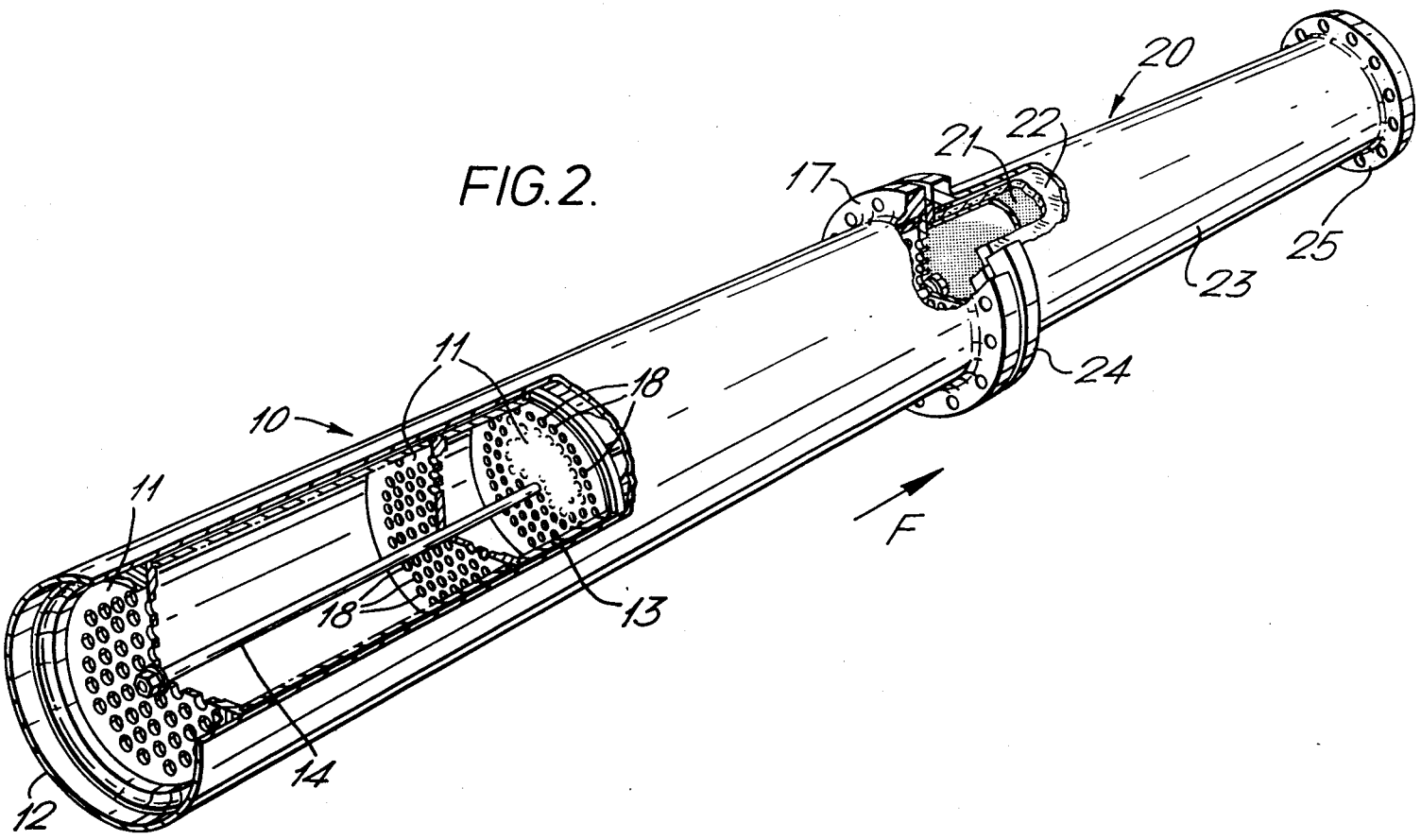

The invention will now be further described by way of example with reference to the accompanying diagrammatic drawings in which:

FIG. 1, is a longitudinal section of a noise reduction unit for use in a gas compressor station venting system, the direction of gas flow being from left to right, FIG. 2, is a partly broken away perspective view of the noise reduction unit in combination with an in-line silencer element, and FIG. 3, is a longitudinal section of the silencer element.

The sound power generated by a free jet of compressible gas issuing from an orifice increases non-linearly with pressure ratio across the orifice. Initially, the sound power increases rapidly until the pressure ratio is about 4, above which the sound power doubles for every doubling of pressure ratio. In existing designs of gas compressor station venting systems, the pressure is usually let down in a single stage, the maximum pressure ratio being about 70. If however, the pressure is degraded equally over two stages then the pressure ratio per stage would be the square root of 70, or 8.4. Increasing the number of stages will increase the noise reduction, the optimum number being about ten when the pressure ratio per stage is $10\sqrt{70}$ or 1.53 and the total sound power is reduced by a factor of forty or 16 dB in power level.

The noise reduction unit 10 shown in FIGS. 1 and 2, is an in-line system which breaks down gas-flow input pressure by means of a series of orifice plates 11 spaced along a 14 inch nominal bore cylindrical pipe or spool 12 by spacer tubes 13, and held together as an assembly of orifice plates by means of a tie-rod 14. The complete assembly of spaced orifice plates 11 and interadjacent chambers is shown in FIG. 1, but only partly in FIG. 2 for the sake of clarity. The overall length of the plate assembly is about 5 feet.

Ring seals 15 are provided between the internal surface of the pipe 12 and the junctions of the orifice plates and spacers. The pipe 12 is provided with flanges 16, 17 at respective ends thereof. The number and hole areas of the orifices 18 in the plates 11 ensures sub-sonic flow through each plate. This considerably reduces the sound power produced by the venting system by:

(i) reducing the acoustical efficiency of the jets from about 1.0 to 0.001%, and (ii) reducing the rate at which the mechanical power is dissipated.

The noise reduction unit 10 designed for use in a compressor station venting system consists of nine stages S1 to S9, the gas flow being indicated by an arrowhead F. The plates 11 of the first four stages S1 to S4 have ¼ inch diameter orifices 18 and an interstage separation of 6 inches, whilst the plates 11 of the remaining stages S5 to S9 have ⅜ inch orifices 9 inches separations.

Preferably, although not exclusively, the number of orifices in the successive plates of a group of plates increases in the direction of gas flow. Thus, in this embodiment, the number of orifices in the respective stages are as follows:

Stage 1—26 × ¼ inch
Stage 2—40 × ¼ inch
Stage 3—62 × ¼ inch
Stage 4—94 × ¼ inch
Stage 5—64 × ⅜ inch
Stage 6—98 × ⅜ inch
Stage 7—150 × ⅜ inch
Stage 8—230 × ⅜ inch
Stage 9—352 × ⅜ inch The separation between adjacent stages is selected to ensure that the kinetic energy in the gas jets is dissipated before the fluid reaches the next stage of pressure reduction.

This particular system was designed to vent high pressure gas to 700 psig to atmosphere. The design interstage pressure ratio is 1.54, giving an overall pressure ratio of 48.7 ie $1.54^9$. The advantage of this type of system are that:

(i) some of the sound energy produced is above the upper frequency limit of the audio range, thus giving an effective noise reduction (ii) the higher frequency sound energy is more readily absorbed in the atmosphere (iii) the exhaust stack becomes markedly directional at higher frequencies; a large proportion of the sound energy being radiated in the direction of the axis of the stack (iv) the higher frequency sound energy is more efficiently absorbed by any dissipative silencer inserted into the line after the unit.

With the exception of the final stage S9, the noise generated by each stage is contained within the volume of each chamber enclosed between consecutive stages. Also, the arrangement of inter-connected multiple expansion chambers constitutes a rather complex reactive silencer, providing additional attenuation. The noise produced by each stage (excluding the last stage) will thus be attenuated during its transmission along the body of the venting unit.

Preferably, the noise reduction unit is used in combination with a modified form of known silencer element. Referring also to FIG. 3, this element 20 consists of a 12 inch nominal bore cylinder 21, 6 feet long, formed from perforated mild steel sheets and wrapped with preformed sound absorbent material, for example, a mineral wool pipe section 22 which is 1¼ inches thick. The preformed pipe section 22 is in 3 feet lengths which readily enables the length of the lined section to be varied. The complete element is housed in a 16 inch diameter pipe or spool piece 23, which is provided with flanges 24, 25 at respective ends thereof.

The noise reduction unit 10 is connected to, and upstream of, the silencer element 20 by bolting the flanges 17 and 24 thereof to a thrust washer 26. Flanges 16 and 25 enable the composite unit to be connected in the blow down piping of a gas compressor station venting system.

I claim:

1. A gas-flow noise reduction unit comprising:

a cylindrical housing an upstream end for receiving a flow of gas and a downstream end for discharging said flow of gas;

means at said upstream and downstream ends for connection of said noise reduction unit in a gas flow conduit such that a flow of gas in said conduit passes through said reduction unit;

a plurality of circular plates located diametrically at predetermined spaced intervals along the length of the internal bore of the housing, each plate being formed with a plurality of orifices of predetermined size and constituting a pressure-reducing stage of the unit, each plate being positioned in groups of two or more plates with equal spacing between plates in each group, the spacing between each adjacent group of plates in the direction of flow from said upstream end of said unit to said downstream end thereof being of progressively increasing dimension and being sufficient to ensure that the kinetic energy in the jets of gas flowing through the orifices in each plate is dissipated before the gas reaches the next plate of the unit; and means for retaining the plates at said location within said housing.

2. A gas-flow noise reduction unit according to claim 1, wherein the number and hole area of the orifices in each plate is such as to ensure sub-sonic flow of gas there-through,

3. A gas-flow noise reduction unit according to claim 2, wherein the number of orifices in the successive plates of a group of plates increases in the direction of gas flow.

4. A gas-flow noise reduction unit according to claim 1, in combination with a silencer element comprising a perforated metal cylinder wrapped with sound-absorbent material, and a cylindrical tubular casing in which the perforated cylinder is housed, the casing being provided with means at each end thereof for connection between said unit and the pipe line of an exhaust stack.

5. The combination of a noise reduction unit and a silencer element according to claim 4, wherein the silencer element is connected downstream of the noise reduction unit.

6. A compressed gas venting system incorporating a gas-flow noise reduction unit according to claim 1, connected in the exhaust stack of the system.

7. A compressed gas venting system incorporating the combination of gas-flow noise reduction unit and a silencer element according to claim 4, connected in the exhaust stack of the system.

8. A method of reducing the noise generated by a flow of gas through a conduit comprising the steps of:

positioning in said conduit a gas flow noise reducing unit, said unit comprising:

a cylindrical housing having an upstream end for receiving said flow of gas and a downstream end for discharging said flow of gas;

means at said upstream and downstream ends for connection of said noise reduction unit in a gas flow conduit such that a flow of gas in said conduit passes through said noise reduction unit;

a plurality of circular plates located diametrically at predetermined spaced intervals along the length of the internal bore of the housing, each plate being formed with a plurality of orifices of predetermined size and constituting a pressure-reducing stage of the unit, each plate being positioned in groups of two or more plates with equal spacing between plates in each group, the spacing between each adjacent group of plates in the direction of flow from said upstream end of said unit to said downstream end thereof being of progressively increasing dimension; and means for retaining the plates at said location within said housing;

causing a flow of gas to flow through said gas flow conduit and said noise reducing unit;

the number and hole area of the orifices in each plate being such that the flow of gas through each plate is sub-sonic and the spacing between plates being sufficient to ensure that the kinetic energy in the jets of gas flowing through the orifices in each plate is dissipated before the gas reaches the next plate of the unit.

* * * * *